US012383010B1

(12) United States Patent
Bessenroth

(10) Patent No.: US 12,383,010 B1
(45) Date of Patent: Aug. 12, 2025

(54) HAIR EXTENSIONS ORGANIZING SYSTEM

(71) Applicant: Melissa Rose Bessenroth, West Palm Beach, FL (US)

(72) Inventor: Melissa Rose Bessenroth, West Palm Beach, FL (US)

( * ) Notice: Subject to any disclaimer, the term of this patent is extended or adjusted under 35 U.S.C. 154(b) by 426 days.

(21) Appl. No.: 18/113,674

(22) Filed: Feb. 24, 2023

Related U.S. Application Data

(60) Provisional application No. 63/314,077, filed on Feb. 25, 2022.

(51) Int. Cl.
*A41G 5/00* (2006.01)

(52) U.S. Cl.
CPC ..... *A41G 5/0046* (2013.01)

(58) Field of Classification Search
CPC ..... A47G 5/004; A47G 5/0073; A47G 5/008; A47G 5/0046; A47G 5/0086; A45D 44/02; A45D 44/04; A45D 44/14
See application file for complete search history.

(56) References Cited

U.S. PATENT DOCUMENTS 3,470,889 A 10/1969 Webb
3,612,071 A 10/1971 Holly
4,296,765 A 10/1981 Bachtell
5,072,745 A 12/1991 Cheh
7,343,921 B2 3/2008 Salinas
8,950,591 B1 * 2/2015 McDowell ..... A45D 44/14 211/13.1
9,198,476 B1 * 12/2015 Kim ..... B65B 5/04
9,510,631 B2 * 12/2016 Kim ..... B65D 85/70
10,034,507 B2 * 7/2018 Thomas ..... A41G 5/0046
10,080,396 B2 * 9/2018 Adjesson ..... A41G 5/004
10,206,487 B2 * 2/2019 Smith ..... A45D 44/14
10,433,631 B2 * 10/2019 Ohlgart ..... F16B 2/10
11,246,363 B2 * 2/2022 Davis ..... B08B 3/04
2014/0261529 A1 * 9/2014 Carvalho ..... A41G 5/0073 132/54
2016/0309882 A1 * 10/2016 Abramyan ..... A45D 44/02
2019/0216152 A1 * 7/2019 Francis ..... A41G 5/0073
2023/0248098 A1 * 8/2023 Leonard ..... A45D 2/00 132/201

(Continued)

FOREIGN PATENT DOCUMENTS

KR 200346499 Y1 * 3/2004 ..... A45D 8/14
KR 20180066972 A * 6/2018 ..... A41G 5/0053

(Continued)

*Primary Examiner* — Patrick D Hawn
(74) *Attorney, Agent, or Firm* — John Rizvi; John Rizvi, P.A.—The Patent Professor ®

(57) ABSTRACT

A hair extensions organizing system having a multi-level structure for holding one or more plurality of hair extensions securely in place while awaiting dispensing from the hair extension system and application to an individual's head. The one or more plurality of hair extensions are placed into and held in place by the hair extensions organizing system thereby facilitating the selection and removal of the hair extensions from the hair extensions organizing system for applying, with no gathering, entangling, snagging, and/or damaging of the one or more plurality of hair extension prior to application to the individual's head thereby allowing for an extremely efficient and repeatable application of the hair extensions.

20 Claims, 8 Drawing Sheets

(56) References Cited

U.S. PATENT DOCUMENTS

| | | | | |
|---|---|---|---|---|
| 2023/0413935 | A1* | 12/2023 | Han | B65D 77/003 |
| 2024/0122283 | A1* | 4/2024 | Adams | A41G 5/004 |

FOREIGN PATENT DOCUMENTS

| | | | | |
|---|---|---|---|---|
| NL | 1022306 | C1 | | 7/2004 |
| TW | M634702 | U | * | 11/2022 |
| WO | 2005044031 | | | 5/2005 |

* cited by examiner

HAIR EXTENSIONS ORGANIZING SYSTEM

CROSS-REFERENCE TO RELATED APPLICATION

This application claims the benefit of U.S. Provisional Patent Application No. 63/314,077, filed Feb. 25, 2022, which is hereby incorporated by reference herein in its entirety.

FIELD OF THE INVENTION

The present invention relates generally to hairstyling techniques, and more particularly, to a system and method for organizing and applying hair extensions to a person's natural hair.

BACKGROUND OF THE INVENTION

Hair extensions have been used in the hair styling industry for many years and are extremely popular. Hair extensions are usually added to a client's existing hair by a hairstylist or other member of the hairstyling industry thereby adding length to human hair, providing individuals with longer hair capable of various additional styles, and appearances unavailable to those with their natural shorter hair. Hairstyling products have been made to enhance the length of a user's hair or to add body or bulk to thinning hair. Hair extensions are lengths of real or artificial hair that can be attached to a person's own natural hair in order to add length and thickness to a person's natural hair. Hair extensions are designed to blend and move naturally with a person's own hair, making it difficult to tell when a person is wearing them. Hair extensions also come in a variety of colors, textures, styles, and lengths, which allow a person to change the appearance of his or her hair. For example, a person's naturally curly hair can be made to look straight by adding and integrating straight hair extensions.

Generally, hair extensions are supplied in a form where the hair extensions are attached to a long and thin strip of material. The hair extensions are attached on one end and extend away from the strip of material in a substantially perpendicular manner. The stylist has to select and separate the hair extensions to be applied and/or braided onto a person's existing hair. In addition, the stylist has to carefully remove the selected hairs and prevent them from entangling or becoming disarranged. Many hair extension products on the market require the use of a liquid adhesive to secure the extensions to users' hair. This generally prevents the average consumer from installing their own extensions.

There are many diverse types of hair extensions known in the art and correlating to distinctive styles, purposes and/or parts of the head. Some example types of hair extensions known in the art include micro-bead hair extensions, fusion hair extensions, clip-in hair extensions, weft hair extensions and tape hair extensions. These diverse types of hair extensions can utilize different means of attachment mechanisms and can correlate to different areas of use in relation to the existing hair on a client's head. During the process of adding hair extensions to a client's existing hair, many hair extension strands are typically utilized. Several of the hair extensions utilized in a treatment are often specifically correlated to certain portions of a client's existing hair and specific locations on a client's head. This can be due to factors such as the color, texture, length, and type of hair extension being used. Furthermore, these specific and individualized hair extensions oftentimes need to be further treated, for example, colored, prior to being added to a client's existing hair.

This process can be cumbersome and time consuming, especially if the hair extensions become entangled. This coupled with the fact that several instances of hair extensions are being utilized simultaneously and the natural tendency of hair to tangle, become damaged and snag on various objects, results in a complicated and inefficient process. Time wasted correlating various hair extensions to their corresponding areas on a client's head further adds to the inefficiency and increased cost of the conventional hair extension process.

Accordingly, there is need for an improved system and method for the organization and application of hair extensions.

SUMMARY OF THE INVENTION

The present invention is directed to a system and method for the organization and application of hair extensions.

In a first implementation of the invention, a hair extensions organizing system is provided, the hair extensions organizing system comprising:

- an upper board having a first thickness, the upper board further comprising:
  - a first surface, the first surface being a substantially smooth surface, and
  - a second surface comprising a first plurality of protrusions affixed thereto and extending outwardly therefrom, the second surface being opposite to and separated from the first surface by the first thickness of the upper board;
- an intermediary board having a second thickness, the intermediary board further comprising:
  - a third surface comprising a second plurality of protrusions affixed thereto and extending outwardly therefrom; and
  - a fourth surface comprising a third plurality of protrusions affixed thereto and extending outwardly therefrom, the third surface being opposite to and separated from the fourth surface by the second thickness of the intermediary board;
- a lower board having a third thickness, the lower board further comprising:
  - a fifth surface comprising a fourth plurality of protrusions affixed thereto and extending outwardly therefrom; and
  - a sixth surface for use as a base for the hair extensions organizing system, the fourth surface being opposite to and separated from the sixth surface by the third thickness of the lower board; and
- wherein the upper board, the intermediary board and the lower board are configured for the intermediary board to be disposed between the upper board and the lower board for holding and dispensing at least one plurality of hair extensions from the hair extensions organizing system when (i) the third surface of the intermediary board comprising the second plurality of protrusions affixed thereto and extending outwardly therefrom is facing and aligned with the second surface of the upper board comprising the first plurality of protrusions affixed thereto and extending outwardly therefrom, and the first plurality of protrusions are in physical contact with the second plurality of protrusions, and (ii) the fourth surface of the intermediary board comprising the third plurality of protrusions affixed thereto and extending outwardly therefrom is facing and aligned with the fifth surface of the lower board comprising the fourth plurality of protrusions affixed thereto and extending outwardly therefrom, and the third plurality of protrusions are in physical contact with the fourth plurality of protrusions.

In a second implementation, a hair extension application method is provided, the hair extension application comprising:

providing a multi-level hair application system configured to hold one or more plurality of hair extensions securely in place while awaiting dispensing from the hair extension system and application to an individual's head;

placing the one or more plurality of hair extensions into the multi-level hair extension system;

removing the one or more plurality of hair extensions from the multi-level hair extension system for applying the one or more plurality of hair extension to the individual's head.

In another aspect, the upper board, the intermediary board, and the lower board are each made of a plexiglass material and the first thickness, the second thickness and the third thickness thereof are substantially equal.

In another aspect, the upper board, the intermediary board, and the lower board are each made of a heat resistant material and the first thickness, the second thickness and the third thickness thereof are substantially equal.

In another aspect, the first plurality of protrusions, the second plurality of protrusions, the third plurality of protrusions and the fourth plurality of protrusions are of substantially equal size and shape.

In another aspect, the first plurality of protrusions, the second plurality of protrusions, the third plurality of protrusions and the fourth plurality of protrusions share a substantially same configuration.

In another aspect, each of the first plurality of protrusions, the second plurality of protrusions, the third plurality of protrusions and the fourth plurality of protrusions are separated into two respective equal sets of protrusions.

In another aspect, the physical contact between the first plurality of protrusions and the second plurality of protrusions results in an interleaving of the first plurality of protrusions with the second plurality of protrusions resulting in a first interlocking of the upper board with the intermediary board, and the physical contact between the third plurality of protrusions and the fourth plurality of protrusions results in an interleaving of the third plurality of protrusions and the fourth plurality of protrusions resulting in a second interlocking of the intermediary board with the lower board.

In another aspect, the first surface comprises an optional heatproof layer affixed thereto.

In another aspect, the optional heatproof layer of the first surface is a rubber surface.

In another aspect, the optional heatproof layer is a rubber surface that may or may not be patterned (e.g., a dimpled or cross-bar pattern) and is permanently affixed with an adhesive such that the heatproof layer remains in direct contact with the first surface.

In another aspect, optional heatproof layer facilitates the disposal of one or more hair styling instruments (e.g., a flat iron or hair extension tool) thereon during the use of the hair extensions organizing system to apply hair extensions to an individual.

In another aspect, the first plurality of protrusions, the second plurality of protrusions, the third plurality of protrusions and the fourth plurality of protrusions are made of a high-strength, heat resistant metal material.

In another aspect, the first plurality of protrusions, the second plurality of protrusions, the third plurality of protrusions and the fourth plurality of protrusions are made of a high-strength, heat resistant plastic material.

In another aspect, the rubber surface is dimpled and configured for securing one or more hair styling instruments when placed thereon.

In another aspect, the upper board, the intermediary board, and the lower board are each configured in a substantially rectangular shape.

In another aspect, the one or more plurality of hair extensions are a maximum of 508 mm (20 inches) in length.

In another aspect, each hair extension of the one or more plurality of hair extensions is individually selectable when held by the hair extensions organizing system.

In another aspect, the first plurality of protrusions, the second plurality of protrusions, the third plurality of protrusions and the fourth plurality of protrusions are teeth-like protrusions.

In another aspect, the first plurality of protrusions, the second plurality of protrusions, the third plurality of protrusions and the fourth plurality of protrusions are configured to hold the one or more plurality of hair extensions securely in place while awaiting dispensing from the hair extensions organizing system and application to an individual's head.

In another aspect, the first interlocking and the second interlocking provides for a multi-level structure for the hair extensions organizing system.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Figure 1:
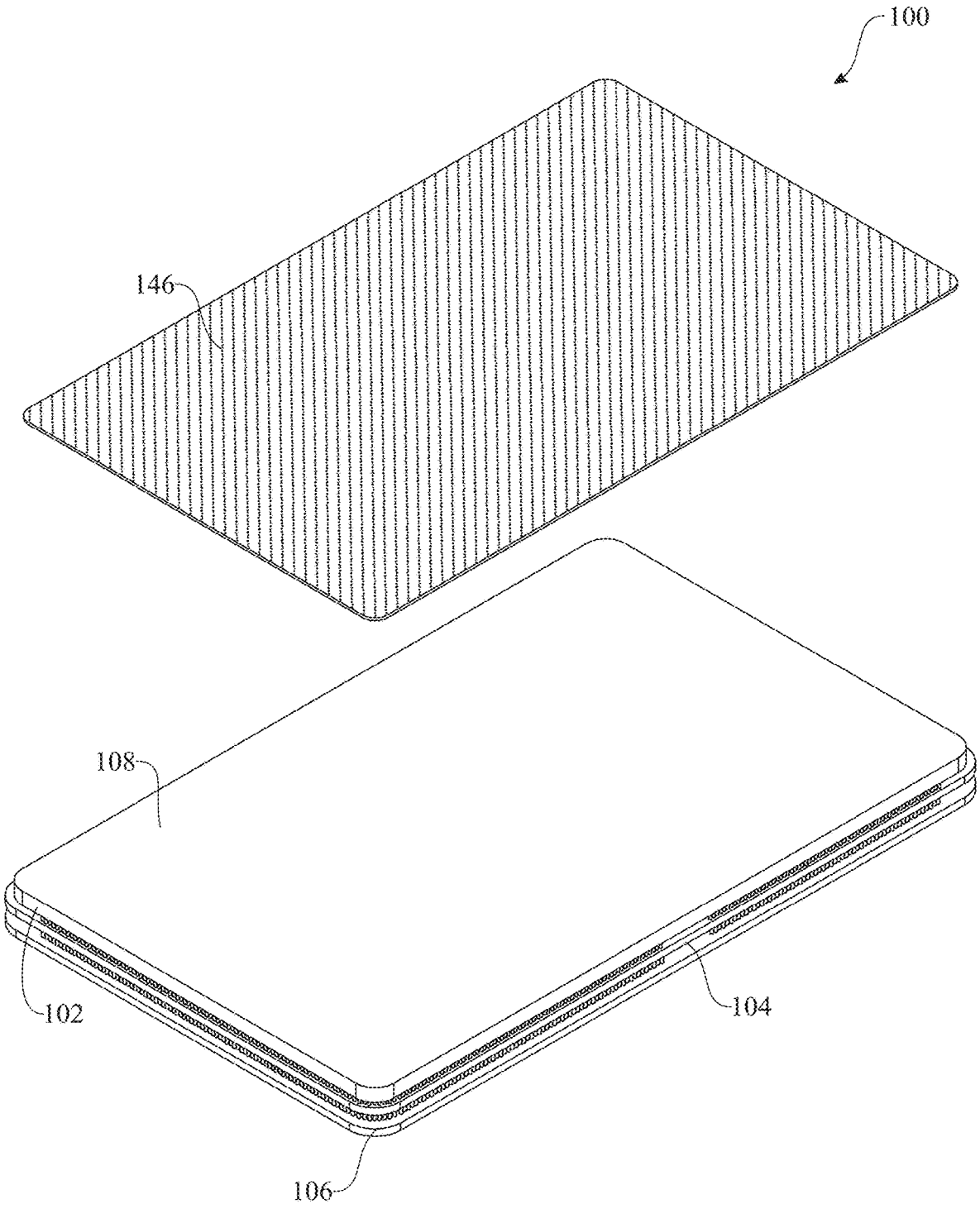
FIG. 1 presents a front, top isometric view of a hair extensions organizing system in accordance with an illustrative embodiment of the present invention.

1 for applying a plurality of hair extension to an individual's head in accordance with an illustrative embodiment of the present invention.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a system and method for the organization and application of hair extensions. More particularly, a hair extensions organizing system is configured to hold one or more plurality of hair extensions securely in place while awaiting dispensing from the hair extension system and application to an individual's head. The hair extensions organizing system comprises a multi-level configuration. The one or more plurality of hair extensions are placed into and held place by the hair extensions organizing system thereby facilitating removing the one or more plurality of hair extensions from the hair extensions organizing system for applying the one or more plurality of hair extension to the individual's head. In this way, the hair extensions organizing system and method ensure there is no gathering, entangling, snagging, and/or damaging of the one or more plurality of hair extension prior to application to the individual's head thereby allowing for an extremely efficient and repeatable application of the hair extensions.

Figure 2:
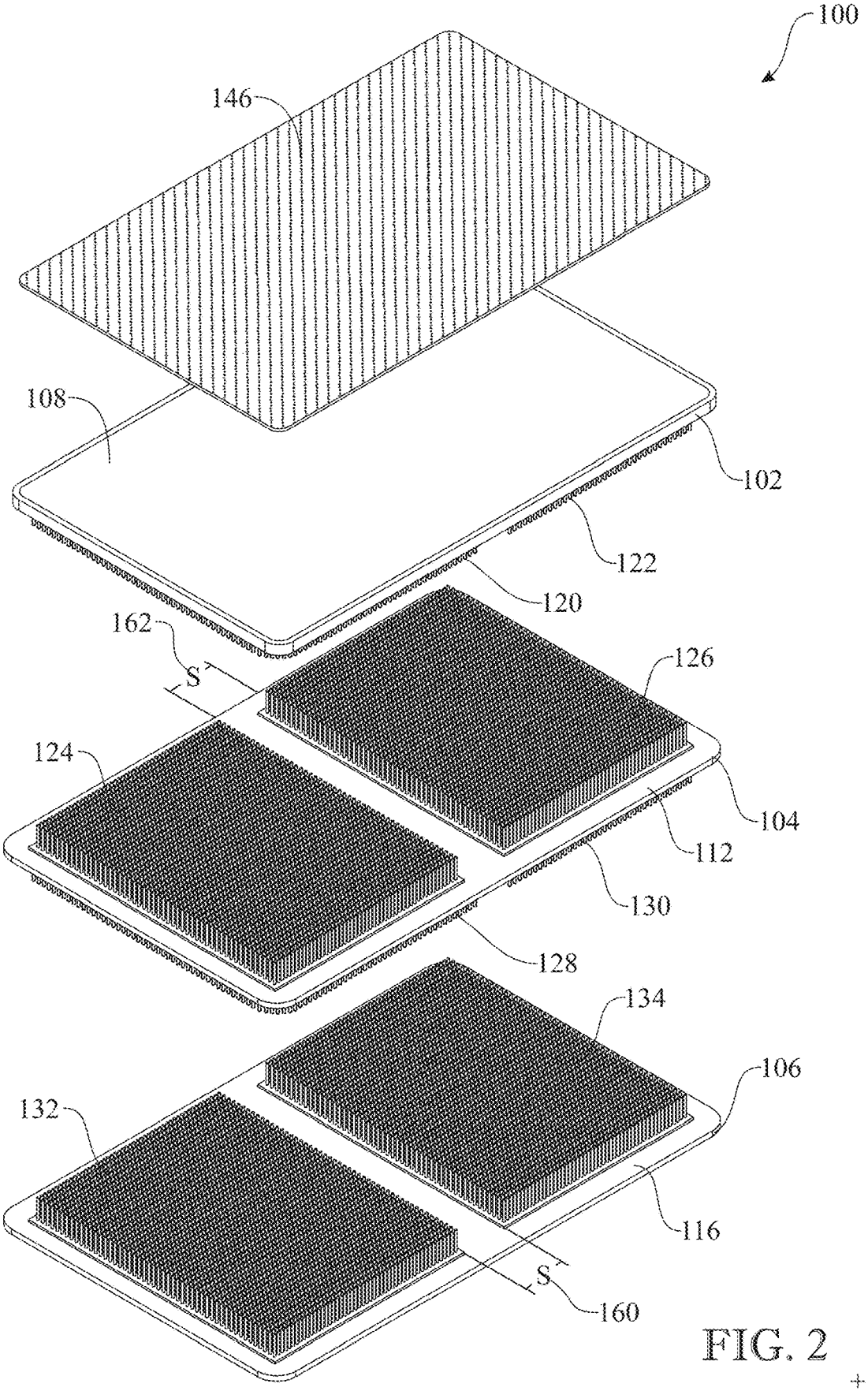
FIG. 2 presents an exploded top view of the hair extensions organizing system of FIG. 1 in accordance with an illustrative embodiment of the present invention.
Figure 3:
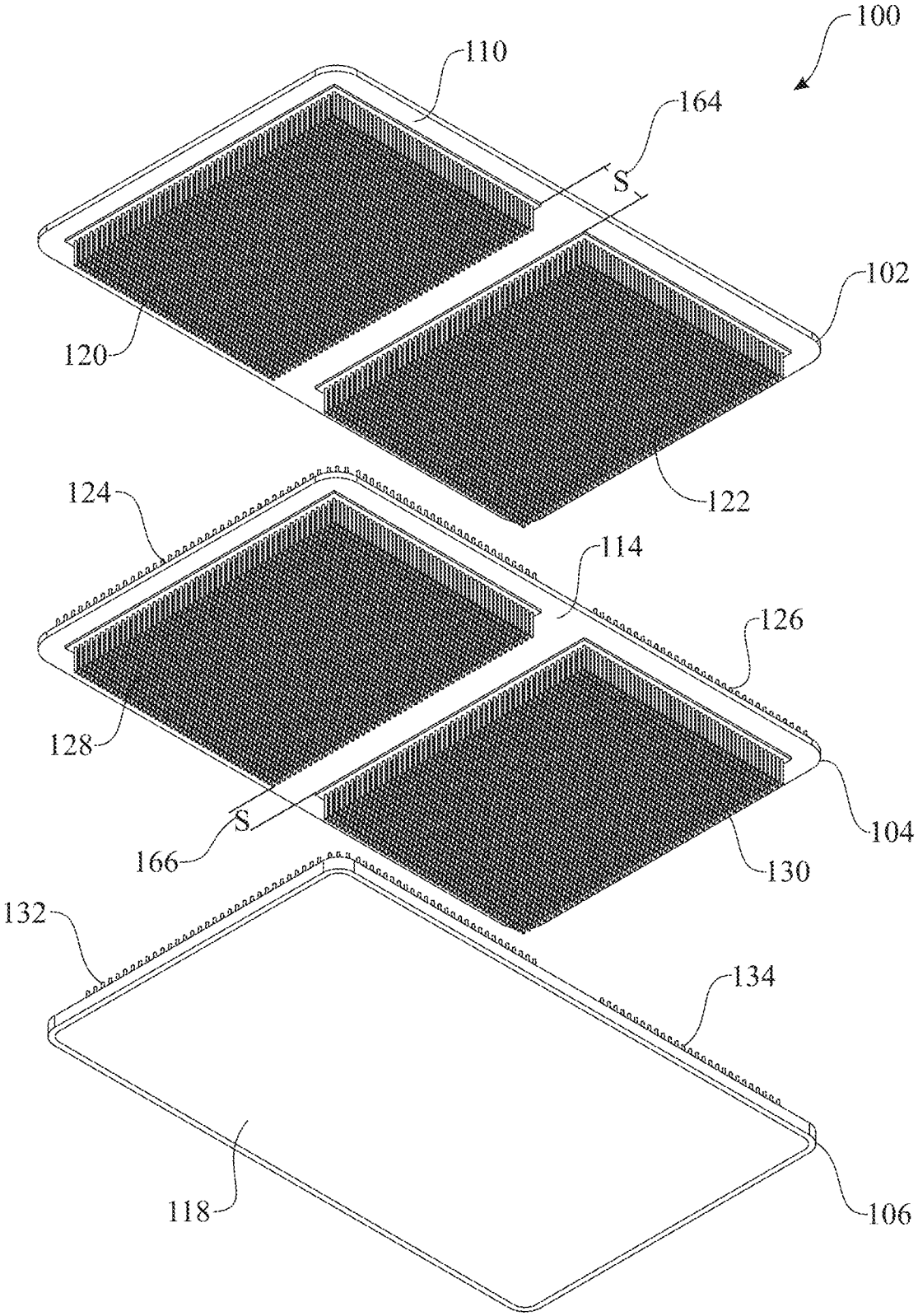
FIG. 3 presents an exploded bottom view of the hair extensions organizing system of FIG. 1 in accordance with an illustrative embodiment of the present invention.
Figure 4:
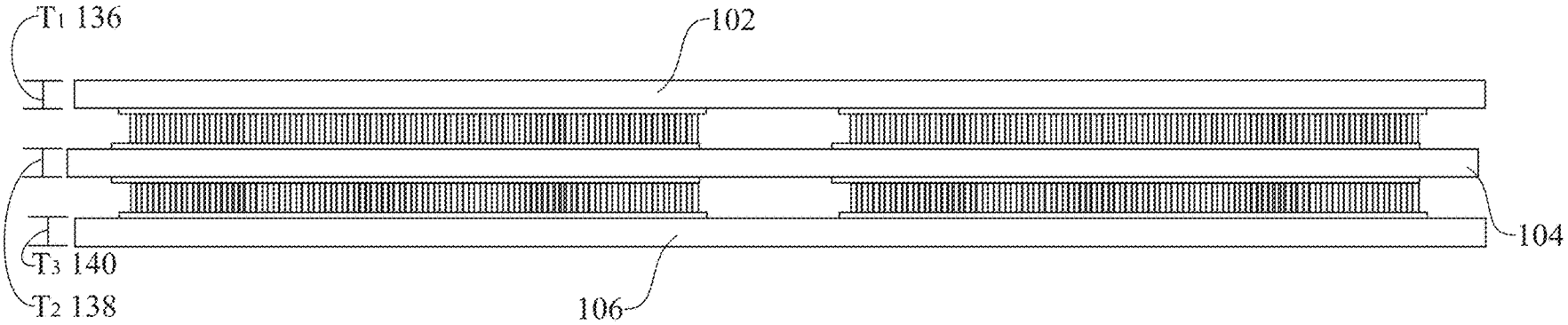
FIG. 4 presents a side view of the hair extensions organizing system of FIG. 1 in accordance with an illustrative embodiment of the present invention.

Turning our attention initially to FIGS. 1, 2, 3, and 4 a hair extensions organizing system 100 is shown in accordance with an illustrative embodiment of the present invention. In particular, FIG. 1 presents a front, top isometric view of the hair extensions organizing system 100 which has a multi-level structure comprising a plurality of boards, FIG. 2 presents an exploded top view of the hair extensions organizing system 100, FIG. 3 presents an exploded bottom view of the hair extensions organizing system 100, and FIG. 4 presents a side view of the hair extensions organizing system 100. The plurality of boards, in the embodiment shown, comprise an upper board 102, an intermediary board 104 and a lower board 106. In a preferred embodiment, each of the upper board 102, the intermediary board 104 and the lower board 106 are made of a lightweight, heat resistant material (e.g., thermosets, thermoplastics, plexiglass, or carbon fiber) with each such board having a respective thickness (i.e., thickness T1 136, thickness T2 138, and thickness T3 140) that is substantially equal, but other thicknesses including, but not limited to, variable thicknesses for the plurality of boards may be used in accordance with the principles of the disclosed embodiments. The upper board 102 further comprises a first surface 108 (i e, a top surface) and a second surface 110 (i.e., a bottom surface). The first surface 108 being a substantially smooth surface (e.g., a plexiglass material surface). In an embodiment, the first surface 108 comprises an optional heatproof layer 146 affixed thereto. Illustratively, the optional heatproof layer 146 is a rubber surface that may or may not be patterned (e g., a dimpled or cross-bar pattern) and is permanently affixed with an adhesive such that the heatproof layer 146 remains in direct contact with the first surface 108. The optional heatproof layer 146 facilitates the disposal of one or more hair styling instruments (e g., a flat iron or hair extension tool) thereon during the use of the hair extensions organizing system 100 to apply hair extensions to an individual, as will be further detailed herein below. The second surface 110 of the upper board 102 comprises a first plurality of protrusions comprised by protrusions 120 and protrusions 122, respectively, affixed thereto and extending outwardly therefrom, the second surface 110 being opposite to and separated from the first surface 108 by a first thickness (i.e., thickness T1 136) of the upper board 102. Protrusions 120 and protrusions 122 of the first plurality of protrusions are separated by a defined separation 164 on the second surface 110. Of course, this is only one of many possible configurations of the first plurality of protrusions that may include a separation of any size, but the separation is optional, and the first plurality of protrusions may not have any separation on the second surface 110 and encompass substantially the entirety of the second surface 110.

The intermediary board 104 further comprises a third surface 112 (i.e., top surface) and a fourth surface 114 (i.e., bottom surface) with the third surface 112 having a second plurality of protrusions comprised by protrusions 124 and protrusions 126, respectively, affixed thereto and extending outwardly therefrom, the third surface 112 being opposite to and separated from the fourth surface 114 by a second thickness (i.e., thickness $T_2$ 138) of the intermediary board 104. The fourth surface 114 having a fourth plurality of protrusions comprised by protrusions 128 and protrusions 130, respectively, affixed thereto and extending outwardly therefrom. Protrusions 124 and protrusions 126 of the third plurality of protrusions are separated by a defined separation 162 on the third surface 112, and protrusions 128 and protrusions 130 of the fourth plurality of protrusions are separated by a defined separation 166. Of course, this is only one of many possible configurations of the third and fourth plurality of protrusions that may include a separation but the separation is optional, and either or both of the third and fourth plurality of protrusions may not have any separation on the third surface 112 and/or the fourth surface 114 of the intermediary board 104 such that the third plurality of protrusions and/or the fourth plurality of protrusions may not have any separation on the third surface 112 and/or the fourth surface 114 and encompass substantially the entirety of the respective surfaces of the intermediary board 104.

Figure 7:
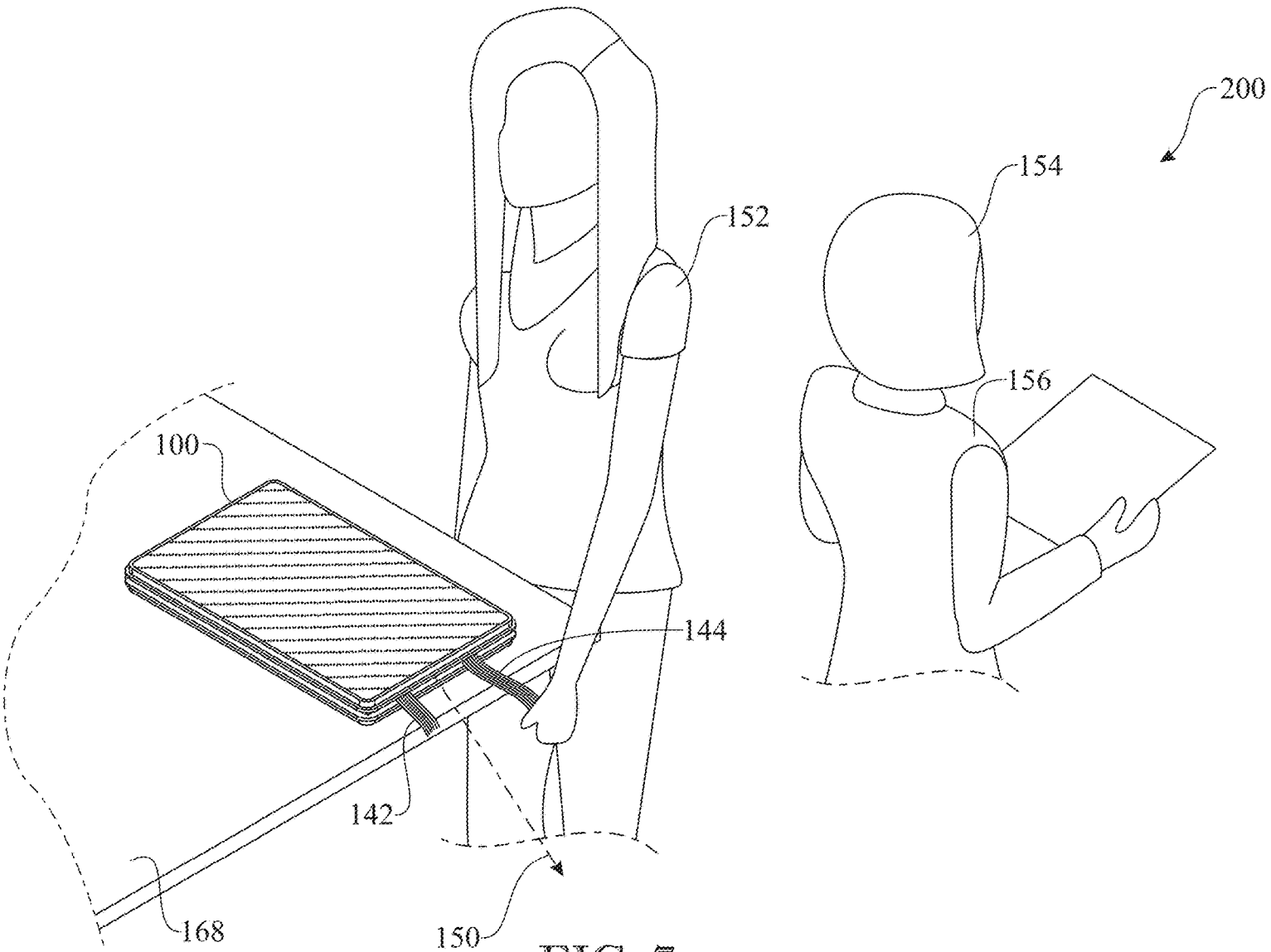
FIG. 7 presents a schematic view of a hairstylist engaged with and employing the hair extensions organizing system of FIG. 1 in accordance with an illustrative embodiment of the present invention.

The lower board 106 further comprises a fifth surface 116 (i.e., a top surface) and a sixth surface 118 (i.e., a bottom surface). The sixth surface 118 serves as a base for the hair extensions organizing system 100 for placement on any flat surface (e.g., table 168 as shown in FIG. 7). As such, the sixth surface 118 is a substantially smooth surface to allow for a level placement and support any flat surface. In this way, the compact configuration of the hair extensions organizing system 100 allows for easy assembly/disassembly and portability between any location for application of hair extensions. The fifth surface 116 of the lower board 106 comprises a fourth plurality of protrusions comprised by protrusions 132 and protrusions 134, respectively, affixed thereto and extending outwardly therefrom, the fifth surface 116 being opposite to and separated from the sixth surface 118 by a third thickness (i.e., thickness $T_3$ 140) of the lower board 106. Protrusions 132 and protrusions 134 of the fourth plurality of protrusions are separated by a defined separation 160 on the fifth surface 116. Of course, this is only one of many possible configurations of the fourth plurality of protrusions that may include a separation of any size, but the separation is optional, and the fourth plurality of protrusions may not have any separation on the fifth surface 116 and encompass substantially the entirety of the fifth surface 116 of the lower board 106.

In the embodiment shown, the upper board 102, the intermediary board 104 and the lower board 106 are each configured in a substantially rectangular shape. As will be appreciated, other shapes and sizes may be utilized consistent with the principles of the disclose embodiments. The first plurality of protrusions comprised by the protrusions 120 and 122, the second plurality of protrusions comprised by the protrusions 124 and 126, the third plurality of protrusions comprised by the protrusion 128 and 130 and the fourth plurality of protrusions comprised by the protrusions 132 and 134 are configured such that individual protrusions are of substantially equal size and shape (e.g., comb teeth) and share a common/same configuration. In an embodiment, the first plurality of protrusions, the second plurality of protrusions, the third plurality of protrusions and the fourth plurality of protrusions are teeth-like protrusions. In an embodiment, the first plurality of protrusions, the second plurality of protrusions, the third plurality of protrusions and the fourth plurality of protrusions are made of a high-strength, heat resistant metal material (e.g., stainless steel or aluminum). In another aspect, the first plurality of protrusions, the second plurality of protrusions, the third plurality of protrusions and the fourth plurality of protrusions are made of a high-strength, heat resistant plastic material (e.g., thermosets, thermoplastics, or carbon fiber). Further, as noted above, in the subject embodiment each of the first plurality of protrusions, the second plurality of protrusions, the third plurality of protrusions and the fourth plurality of protrusions are separated into two respective equal sets of protrusions (i.e., the protrusions 120 and 122, the protrusions 124 and 126, the protrusions 128 and 130, and the protrusions 132 and 134). As shown for example in FIG. 4, the hair extensions organizing system 100 is configured and assembled such that the physical contact between the first plurality of protrusions and the second plurality of protrusions (i.e., the protrusions 120 and 122 with the protrusions 124 and 126) results in an interleaving of the first plurality of protrusions with the second plurality of protrusions resulting in a first interlocking of the upper board 102 with the intermediary board 104. Similarly, the physical contact between the third plurality of protrusions and the fourth plurality of protrusions (i.e., the protrusions 128 and 130 with the protrusions 132 and 134) results in an interleaving of the third plurality of protrusions and the fourth plurality of protrusions resulting in a second interlocking of the intermediary board 104 with the lower board 106. In this way, in accordance with the principles of the disclosed embodiments, the first plurality of protrusions, the second plurality of protrusions, the third plurality of protrusions and the fourth plurality of protrusions are configured to hold the one or more plurality of hair extensions (e.g., plurality of hair extensions 142 and 144, respectively; see FIGS. 6-8) securely in place while awaiting dispensing from the hair extension system 100 and application to an individual's head, as will be further detailed herein below.

Figure 5:
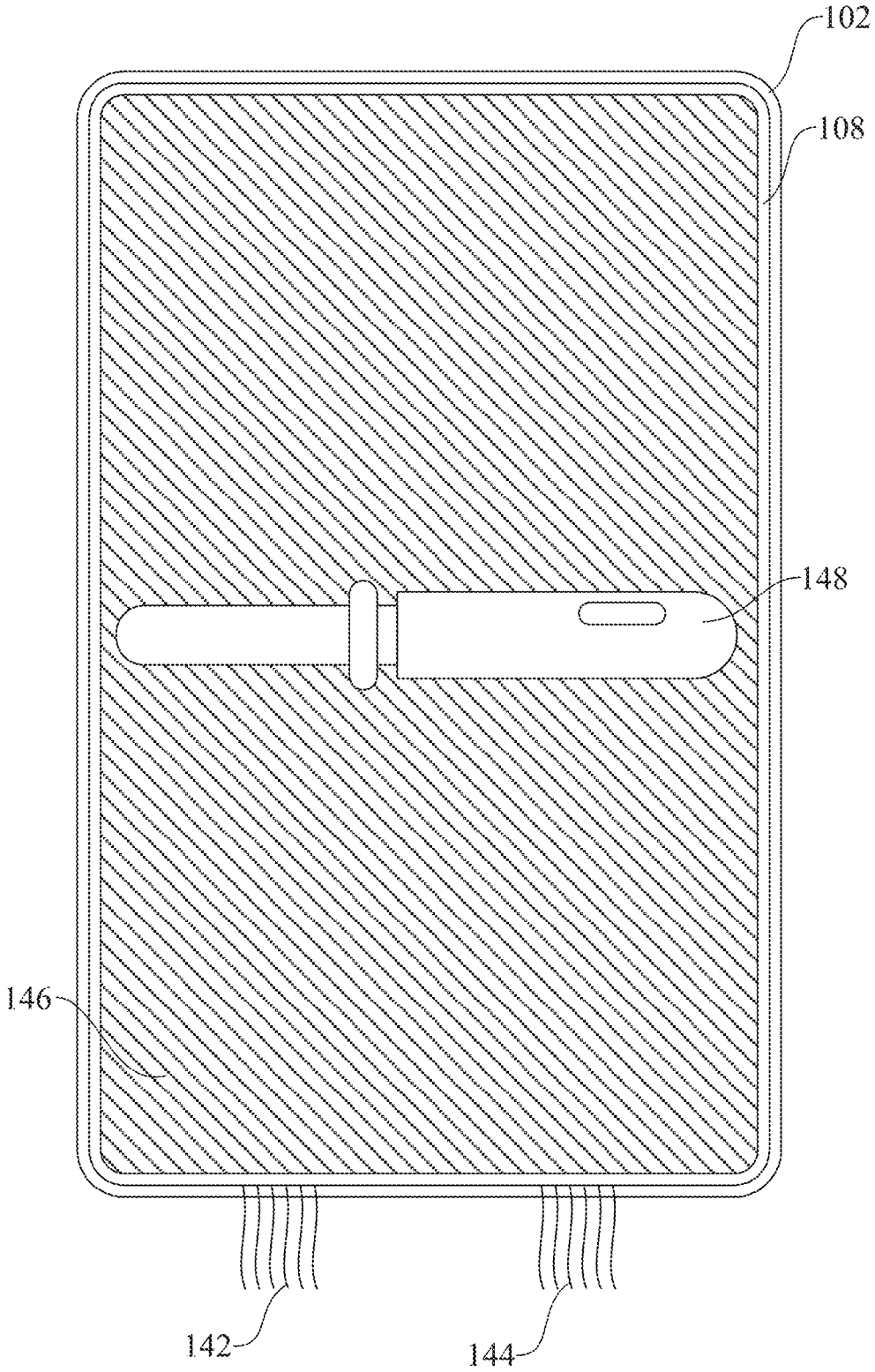
FIG. 5 presents a top elevation view of the hair extensions organizing system FIG. 1 in accordance with an illustrative embodiment of the present invention.
Figure 6:
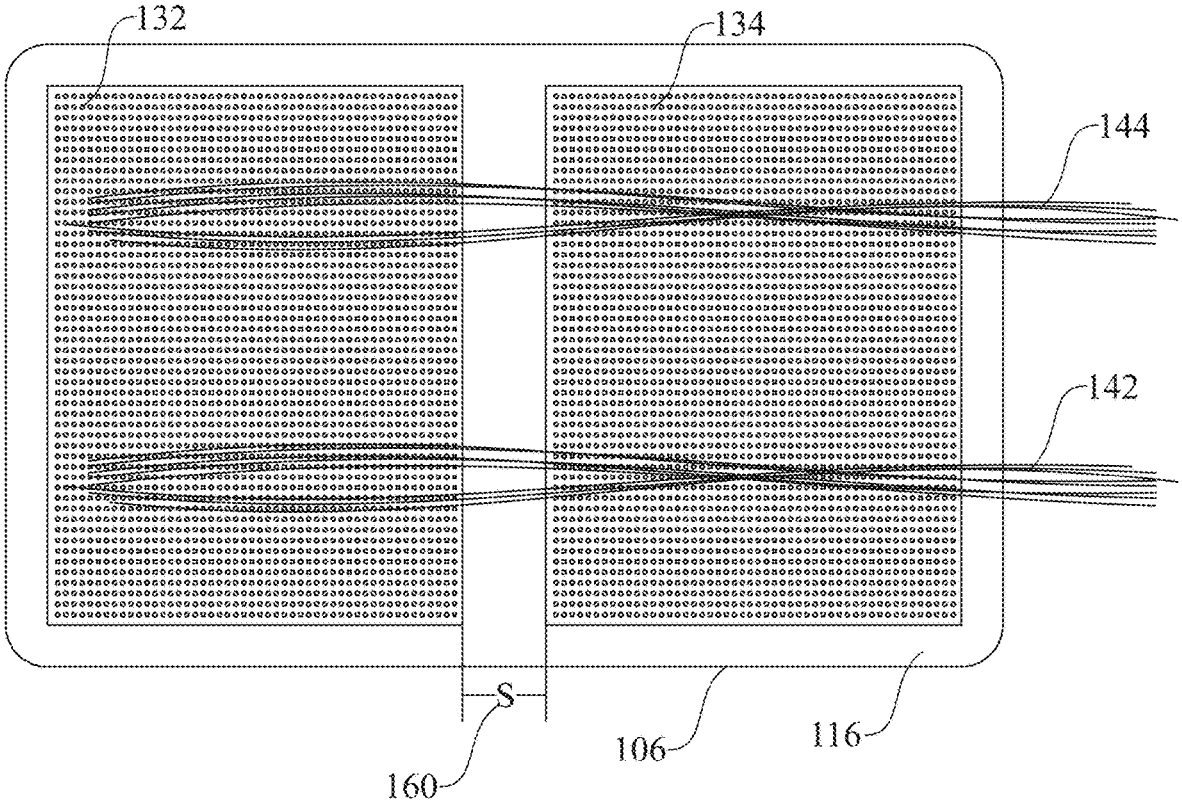
FIG. 6 presents an elevation view of the intermediary board the hair extensions organizing system of FIG. 1 with a plurality of hair extension held thereby in accordance with an illustrative embodiment of the present invention.

Turning our attention to FIGS. 5, 6, 7, and 8, the use and application of the hair extensions organizing system 100 hereunder will be discussed in further detail. More particularly, FIG. 5 presents a top elevation view of the hair extensions organizing system 100 in accordance with an illustrative embodiment of the present invention demonstrating the utility of the optional heatproof layer 146 affixed to the first surface 108, as described above. As shown, hair-styling instrument 148 may be placed directly on the first surface 108 without concern of damage from any heat dissipating therefrom during the use of the hair extensions organizing system 100 in applying hair extensions (e.g., the plurality of hair extensions 142 and 144, respectively). Ideally, the plurality of hair extensions 142 and 144 are held in place and protrude outwardly from the hair extensions organizing system 100 by a fixed length (e.g., in the range of 25 mm to 50 mm (1 inches to 2 inches)) to allow for each individual hair extension of the plurality of hair extensions to be selected (or multiple individual hair extensions) and grasped by the user (e.g., hairstylist 152; see FIGS. 7-8) for application to an individual (e.g., individual 156). FIG. 6 shows an elevation view of the intermediary board 106 of the hair extensions organizing system in accordance with an embodiment of the present invention where the plurality of hair extensions 142 and 144, respectively, are placed down across the protrusions 132 and 134 of the fourth plurality of protrusions extending from the fifth surface 116 of the lower board 106. In this way, as detailed above, the physical contact between the third plurality of protrusions and the fourth plurality of protrusions (i.e., the protrusions 128 and 130 with the protrusions 132 and 134) results in an interleaving of the third plurality of protrusions and the fourth plurality of protrusions resulting in a second interlocking of the intermediary board 104 with the lower board thereby holding the plurality of hair extensions 142 and 144, respectively, securely in place while awaiting dispensing from the hair extension system 100 and application to the individual's head 154. As will be appreciated, the plurality of hair extensions 142 and 144 for example, typically come in two different makes: synthetic or human, each of which are suitable for use in accordance with the principles of the disclosed embodiment hereunder. Synthetic extensions are a man-made keratin/plastic mix that mimics the appearance of human hair. Human hair is donated by real people and repurposed into extensions. Human hair extensions also come in many grades, such as the popular grades of Brazilian, Indian, and Malaysian. Synthetic extensions are particularly good for mimicking the appearance of human hair, but typically lack some of the texture that natural hair maintains. At the same time, synthetic extensions tend to be shinier than natural human hair. Human hair is much more expensive than synthetic hair, but it is also more versatile and natural looking. Unlike synthetic extensions, human hair can be styled with heat tools, chemically treated, colored, and washed and styled. In accordance with the embodiments hereunder, the one or more plurality of hair extensions are a maximum of 508 mm (20 inches) in length.

Figure 8:
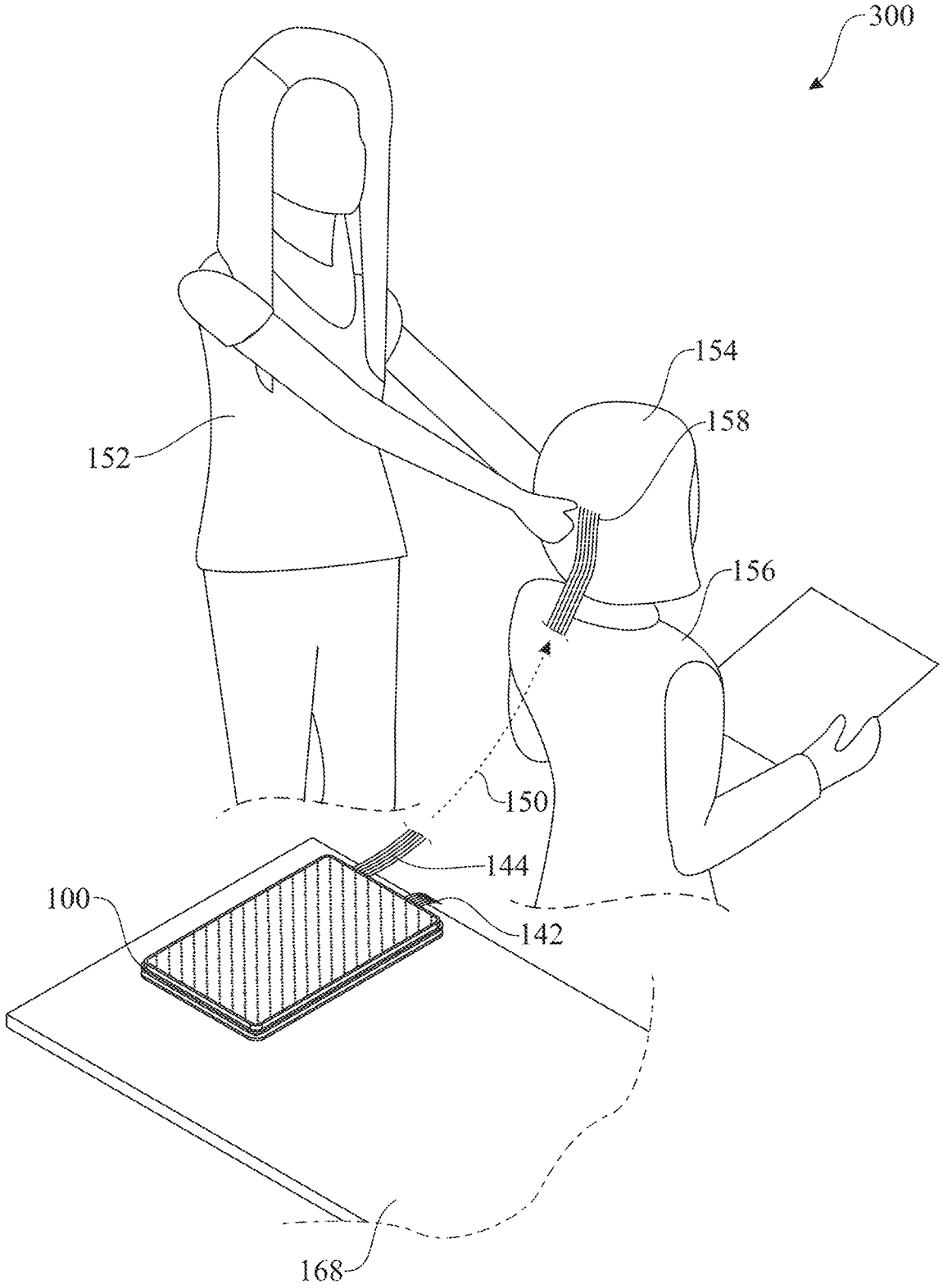
FIG. 8 presents a schematic view of the hairstylist of FIG. 7 employing the hair extensions organizing system of FIG.

This is further illustrated in FIGS. 7 and 8, which present schematic views 200 and 300 of the hairstylist 152 engaged with, employing, and applying the plurality of hair extensions 142 and 144, respectively, to the individual's head using the hair extensions organizing system 100 in accordance with an illustrative embodiment of the present invention. As shown, the hair extension system 100 is placed illustratively on table 168 (or any other substantially flat surface, for example) such that the hairstylist 152 is able to select and grab one or more of the hair extensions from the plurality of hair extension 144 and pull the one or more hair extensions from the hair extensions organizing system 100 in a direction 150 outwardly and away from the hair extensions organizing system 100. Then, continuing in the direction 150, the hairstylist 152 having selected the particular ones of the hair extensions from the plurality of hair extensions 144 for application, will affix these hair extensions to the individual's head 154 at a desired hair location 158 in the normal course. That is, each hair extension of the one or more plurality of hair extensions is individually selectable when held by the hair extension system 100. The process will continue until such time that the desired number of hair extension are pulled, selected, and applied form the hair extensions organizing system 100 to the individual's head 154.

In a second implementation, a hair extension application method is provided, the hair extension application comprising: providing a hair extensions organizing system configured to hold one or more plurality of hair extensions securely in place while awaiting dispensing from the hair extensions organizing system and application to an individual's head; placing the one or more plurality of hair extensions into the hair extensions organizing system; removing the one or more plurality of hair extensions from the hair extensions organizing system for applying the one or more plurality of hair extension to the individual's head. The hair extensions organizing system being provided in accordance with the foregoing operations configures in accordance with the hair extensions organizing system 100, as detailed herein above.

Advantageously, the disclosed embodiments herein provide for a hair extensions organizing system that is lightweight and may be assembled/disassembled quickly thereby providing for ease of use and transportability. The hair extensions organizing system, as facilitated by the interlocking of the plurality of boards, provides for a multi-level structure for the hair extension system is configured to hold one or more plurality of hair extensions securely in place while awaiting dispensing from the hair extension system and application to an individual's head. The one or more plurality of hair extensions are placed into and held in place by the hair extensions organizing system thereby facilitating removing the one or more plurality of hair extensions from the hair extensions organizing system for applying the one or more plurality of hair extension to the individual's head. In this way, the hair extensions organizing system and method ensure there is no gathering, entangling, snagging, and/or damaging of the one or more plurality of hair extension prior to application to the individual's head thereby allowing for an extremely efficient and repeatable application of the hair extensions.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A hair extensions organizing system comprising:

an upper board having a first thickness, the upper board further comprising:

a first surface, the first surface being a substantially smooth surface; and a second surface comprising a first plurality of protrusions affixed thereto and extending outwardly therefrom, the second surface being opposite to and separated from the first surface by the first thickness of the upper board;

an intermediary board having a second thickness, the intermediary board further comprising:

a third surface comprising a second plurality of protrusions affixed thereto and extending outwardly therefrom; and a fourth surface comprising a third plurality of protrusions affixed thereto and extending outwardly therefrom, the third surface being opposite to and separated from the fourth surface by the second thickness of the intermediary board;

a lower board having a third thickness, the lower board further comprising:

a fifth surface comprising a fourth plurality of protrusions affixed thereto and extending outwardly therefrom; and a sixth surface for use as a base for the hair extensions organizing system, the fourth surface being opposite to and separated from the sixth surface by the third thickness of the lower board; and wherein the upper board, the intermediary board and the lower board are configured for the intermediary board to be disposed between the upper board and the lower board for holding and dispensing at least one plurality of hair extensions from the hair extensions organizing system when (i) the third surface of the intermediary board comprising the second plurality of protrusions affixed thereto and extending outwardly therefrom is facing and aligned with the second surface of the upper board comprising the first plurality of protrusions affixed thereto and extending outwardly therefrom, and the first plurality of protrusions are in physical contact with the second plurality of protrusions, and (ii) the fourth surface of the intermediary board comprising the third plurality of protrusions affixed thereto and extending outwardly therefrom is facing and aligned with the fifth surface of the lower board comprising the fourth plurality of protrusions affixed thereto and extending outwardly therefrom, and the third plurality of protrusions are in physical contact with the fourth plurality of protrusions.

2. The hair extensions organizing system of claim 1, wherein the upper board, the intermediary board and the lower board are each made of a plexiglass material and the first thickness, the second thickness and the third thickness are substantially equal.

3. The hair extensions organizing system of claim 1, wherein the first plurality of protrusions, the second plurality of protrusions, the third plurality of protrusions and the fourth plurality of protrusions are of substantially equal size and shape.

4. The hair extensions organizing system of claim 1, wherein the first plurality of protrusions, the second plurality of protrusions, the third plurality of protrusions and the fourth plurality of protrusions share a same configuration.

5. The hair extensions organizing system of claim 1, wherein each of the first plurality of protrusions, the second plurality of protrusions, the third plurality of protrusions and the fourth plurality of protrusions are separated into two respective equal sets of protrusions.

6. The hair extensions organizing system of claim 1, wherein the physical contact between the first plurality of protrusions and the second plurality of protrusions results in an interleaving of the first plurality of protrusions with the second plurality of protrusions resulting in a first interlocking of the upper board with the intermediary board, and the physical contact between the third plurality of protrusions and the fourth plurality of protrusions results in an interleaving of the third plurality of protrusions and the fourth plurality of protrusions resulting in a second interlocking of the intermediary board with the lower board.

7. The hair extensions organizing system of claim 1, wherein the first plurality of protrusions, the second plurality of protrusions, the third plurality of protrusions and the fourth plurality of protrusions are made of a metal material.

8. The hair extensions organizing system of claim 1, wherein the first plurality of protrusions, the second plurality of protrusions, the third plurality of protrusions and the fourth plurality of protrusions are made of a high-strength, heat resistant plastic material, and the upper board, the intermediary board and the lower board are each made of the heat resistant plastic material and the first thickness, the second thickness and the third thickness are substantially equal.

9. The hair extensions organizing system of claim 1, wherein the upper board, the intermediary board and the lower board are each configured in a rectangular shape.

10. The hair extensions organizing system of claim 1, wherein the one or more plurality of hair extensions are a maximum of 508 mm (20 inches) in length.

11. The hair extensions organizing system of claim 1, wherein each hair extension of the one or more plurality of hair extensions is individually selectable when held by the hair extensions organizing system.

12. The hair extensions organizing system of claim 1, wherein the first plurality of protrusions, the second plurality of protrusions, the third plurality of protrusions and the fourth plurality of protrusions are teeth-like protrusions.

13. The hair extensions organizing system of claim 1, wherein the first plurality of protrusions, the second plurality of protrusions, the third plurality of protrusions and the fourth plurality of protrusions are configured to hold the one or more plurality of hair extensions securely in place while awaiting dispensing from the hair extensions organizing system and application to an individual's head.

14. The hair extensions organizing system claim 6, wherein the first interlocking and the second interlocking provides for a multi-level structure for the hair extensions organizing system.

15. The hair extensions organizing system claim 1, wherein first surface further comprises a heatproof layer affixed thereto.

16. A hair extensions organizing system comprising:

an upper board having a first thickness, the upper board further comprising:

a first surface, the first surface being a substantially smooth surface; and a second surface comprising a first plurality of protrusions affixed thereto and extending outwardly therefrom, the second surface being opposite to and separated from the first surface by the first thickness of the upper board;

an intermediary board having a second thickness, the intermediary board further comprising:

a third surface comprising a second plurality of protrusions affixed thereto and extending outwardly therefrom; and a fourth surface comprising a third plurality of protrusions affixed thereto and extending outwardly therefrom, the third surface being opposite to and separated from the fourth surface by the second thickness of the intermediary board;

a lower board having a third thickness, the lower board further comprising:

a fifth surface comprising a fourth plurality of protrusions affixed thereto and extending outwardly therefrom; and a sixth surface for use as a base for the hair extensions organizing system, the fourth surface being opposite to and separated from the sixth surface by the third thickness of the lower board;

wherein the upper board, the intermediary board and the lower board are each made of a heat resistant material and the first thickness, the second thickness and the third thickness are substantially equal;

wherein the first plurality of protrusions, the second plurality of protrusions, the third plurality of protrusions and the fourth plurality of protrusions are teeth-like protrusions; and wherein the upper board, the intermediary board and the lower board are configured for the intermediary board to be disposed between the upper board and the lower board for holding and dispensing at least one plurality of hair extensions from the hair extensions organizing system when (i) the third surface of the intermediary board comprising the second plurality of protrusions affixed thereto and extending outwardly therefrom is facing and aligned with the second surface, of the upper board comprising the first plurality of protrusions affixed thereto and extending outwardly therefrom, and the first plurality of protrusions are in physical contact with the second plurality of protrusions, and (ii) the fourth surface of the intermediary board comprising the third plurality of protrusions affixed thereto and extending outwardly therefrom is facing and aligned with the fifth surface of the lower board comprising the fourth plurality of protrusions affixed thereto and extending outwardly therefrom, and the third plurality of protrusions are in physical contact with the fourth plurality of protrusions.

17. The hair extensions organizing system of claim 16, wherein the physical contact between the first plurality of protrusions and the second plurality of protrusions results in an interleaving of the first plurality of protrusions with the second plurality of protrusions resulting in a first interlocking of the upper board with the intermediary board, and the physical contact between the third plurality of protrusions and the fourth plurality of protrusions results in an interleaving of the third plurality of protrusions and the fourth plurality of protrusions resulting in a second interlocking of the intermediary board with the lower board.

18. The hair extensions organizing system of claim 16, wherein the first plurality of protrusions, the second plurality of protrusions, the third plurality of protrusions and the fourth plurality of protrusions share a same configuration such that the first plurality of protrusions, the second plurality of protrusions, the third plurality of protrusions and the fourth plurality of protrusions are configured to hold the one or more plurality of hair extensions securely in place while awaiting dispensing from the hair extensions organizing system and application to an individual's head.

19. The hair extension application claim 1, wherein first surface further comprises a heatproof layer affixed thereto, and wherein the heatproof layer is a rubber surface comprising a plurality of dimples configured for securing one or more hair styling instruments when placed thereon.

20. A hair extensions organizing system comprising:

an upper board having a first thickness, the upper board further comprising:

a first surface, the first surface being a substantially smooth surface; and a second surface comprising a first plurality of protrusions affixed thereto and extending outwardly therefrom, the second surface being opposite to and separated from the first surface by the first thickness of the upper board;

an intermediary board having a second thickness, the intermediary board further comprising:

a third surface comprising a second plurality of protrusions affixed thereto and extending outwardly therefrom; and a fourth surface comprising a third plurality of protrusions affixed thereto and extending outwardly therefrom, the third surface being opposite to and separated from the fourth surface by the second thickness of the intermediary board;

a lower board having a third thickness, the lower board further comprising:

a fifth surface comprising a fourth plurality of protrusions affixed thereto and extending outwardly therefrom; and a sixth surface for use as a base for the hair extensions organizing system, the fourth surface being opposite to and separated from the sixth surface by the third thickness of the lower board;

wherein the upper board, the intermediary board and the lower board are each made of a heat resistant material and the first thickness, the second thickness and the third thickness are substantially equal;

wherein the first plurality of protrusions, the second plurality of protrusions, the third plurality of protrusions and the fourth plurality of protrusions are teeth-like metal protrusions and are of substantially equal size and shape;

wherein the upper board, the intermediary board and the lower board are configured for the intermediary board to be disposed between the upper board and the lower board for holding and dispensing at least one plurality of hair extensions from the hair extensions organizing system when (i) the third surface of the intermediary board comprising the second plurality of protrusions affixed thereto and extending outwardly therefrom is facing and aligned with the second surface of the upper board comprising the first plurality of protrusions affixed thereto and extending outwardly therefrom, and the first plurality of protrusions are in physical contact with the second plurality of protrusions, and (ii) the fourth surface, of the intermediary board comprising the third plurality of protrusions affixed thereto and extending outwardly therefrom is facing and aligned with the fifth surface of the lower board comprising the fourth plurality of protrusions affixed thereto and extending outwardly therefrom, and the third plurality of protrusions are in physical contact with the fourth plurality of protrusions; and wherein the first plurality of protrusions, the second plurality of protrusions, the third plurality of protrusions and the fourth plurality of protrusions are configured to hold the one or more plurality of hair extensions securely in place while awaiting dispensing from the hair extensions organizing system and application to an individual's head.

* * * * *